US006466756B1

(12) United States Patent
Nakashima et al.

(10) Patent No.: US 6,466,756 B1
(45) Date of Patent: Oct. 15, 2002

(54) ELECTROPHOTOGRAPHIC DEVICE OF LIQUID TONER DEVELOPING TYPE

(75) Inventors: Yutaka Nakashima, Kanazawa; Akihiko Inamoto, Uchinada-machi; Shigeki Uesugi, Unoke-machi; Satoru Moto, Kanazawa; Motoharu Ichida, Tsubata-machi; Masanari Takabatake, Kanazawa; Shigeharu Okano, Hakui; Seiichi Takeda, Kanazawa; Hironaga Hongawa, Uchinada-machi; Hitoshi Terashima; Satoshi Sakai, both of Kanazawa; Satoshi Miyamoto, Hakui, all of (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 09/762,609

(22) PCT Filed: Jul. 6, 2000

(86) PCT No.: PCT/JP11/04509

§ 371 (c)(1),
(2), (4) Date: May 7, 2001

(87) PCT Pub. No.: WO01/04708

PCT Pub. Date: Jan. 18, 2001

(30) Foreign Application Priority Data

Jul. 7, 1999 (JP) ..... 11-192531

(51) Int. Cl.[7] ..... G03G 15/10
(52) U.S. Cl. ..... 399/249; 399/237
(58) Field of Search ..... 399/98, 101, 237, 399/249, 250, 251, 307, 308, 327, 331

(56) References Cited

U.S. PATENT DOCUMENTS 5,045,891 A * 9/1991 Senba et al. ..... 399/331
5,150,161 A 9/1992 Bujese
5,343,277 A * 8/1994 Rooijakkers et al. ..... 399/101
5,519,476 A * 5/1996 Dalal et al. ..... 399/307
5,592,269 A * 1/1997 Younes et al. ..... 399/237
5,689,780 A * 11/1997 Tamura et al. ..... 399/249
5,723,251 A * 3/1998 Moser ..... 399/249 X
5,774,774 A 6/1998 Tamura et al.
6,173,147 B1 * 1/2001 Nakashima et al. ..... 399/308
6,308,034 B1 * 10/2001 Nakashima et al. ..... 399/249

FOREIGN PATENT DOCUMENTS

| | | |
|---|---|---|
| EP | 0997 792 | 5/2000 |
| JP | 56-81870 | 7/1981 |
| JP | 7-175331 | 7/1995 |
| JP | 11-065290 | 3/1999 |
| JP | 2000-221791 | 8/2000 |
| WO | 94/17455 | 8/1994 |
| WO | 94/23347 | 10/1994 |

* cited by examiner

*Primary Examiner*—Sandra Brase
(74) *Attorney, Agent, or Firm*—Staas & Halsey LLP

(57) ABSTRACT

A toner image is transferred from a photosensitive member 10 onto an intermediate transfer belt 24. Toner particles transferred onto the intermediate transfer belt 24 are melted through application of heat, and the molten toner is transferred onto a printing medium. A carrier-removing roller 29 is disposed downstream of a position where a toner layer on the intermediate transfer belt 24 is melted through application of heat. Through utilization of a phenomenon that toner particles (resin component) are melted and integrated in a heating process and a phenomenon that the carrier solvent (liquid component) is isolated in the heating process, the carrier solvent is removed efficiently. Also, there is disposed at the position of the heating process a carrier-removing roller 28 for removing the carrier solvent from the intermediate transfer belt 24 while the toner layer on the intermediate transfer belt 24 is being melted through application of heat.

14 Claims, 3 Drawing Sheets

Enlarged View of A

ELECTROPHOTOGRAPHIC DEVICE OF LIQUID TONER DEVELOPING TYPE

TECHNICAL FIELD

The present invention relates to a liquid-toner-development-type electrophotographic apparatus. More particularly, the invention relates to a liquid-toner-development-type electrophotographic apparatus in which a toner layer on an intermediate transfer member is melted through application of heat to separate a carrier solvent and a solid component from each other, and the carrier solvent is then removed.

BACKGROUND ART

1. Prior Art

A conventionally known liquid-toner-development-type electrophotographic apparatus uses as a liquid developer a highly viscous liquid toner composed of a liquid carrier (oil) and solid particles, such as pigment, which are dispersed in the liquid carrier (as disclosed in, for example, Japanese Patent Application Laid-Open (kokai) No. 11-65290). A powder toner involves the following problems: toner particles scatter; and toner particles have a relatively large particle size of 7 $\mu$m to 10 $\mu$m, resulting in poor resolution. By contrast, a liquid toner has a small toner particle size of about 1 $\mu$m and can hold a large amount of electrostatic charge. Thus, a toner image is unlikely to be disturbed, and high resolution can be achieved.

FIG. 4 shows the overall configuration of a conventional liquid-toner-development-type electrophotographic apparatus. In FIG. 4, a photosensitive drum 10 is electrostatically charged at about 700 V by means of a charger 11. Subsequently, the photosensitive drum 10 is exposed to light by means of an exposure unit 12, whereby an electrostatic latent image is formed such that an exposed portion assumes an electric potential of about 100 V. A prewetting unit 13 applies silicone oil having a viscosity of about 20 cSt to the surface of the photosensitive drum 10, to a thickness of 4 $\mu$m to 5 $\mu$m.

Developing units 14 corresponding to yellow, magenta, cyan, and black are provided and use as a liquid developer a nonvolatile toner of high viscosity and high concentration having a toner viscosity of 400 mPa·S to 4000 mPa·S and a carrier viscosity of 20 cSt. A developing roller supplies the liquid developer while being in contact with the photosensitive drum 10, in such a manner as to maintain a two-layer structure composed of a toner layer on the developing roller and a prewetting liquid film on the photosensitive drum 10, to thereby cause toner particles contained in the liquid developer to adhere to the photosensitive drum 10 according to an electric field established between the same and the photosensitive drum 10.

An intermediate transfer member 15 is biased at about −500 V to thereby transfer toner particles thereto from the photosensitive drum 10 in the order of yellow, magenta, cyan, and black according to an electric field established between the same and the photosensitive drum 10. A backup roller 20 is adapted to fix on printing paper the toner which is present on the intermediate transfer member 15 and is melted by means of a heating unit 18. The heating unit 18 heats a portion of the surface of the intermediate transfer member 15 at a position located upstream of the backup roller 20.

A carrier solvent used in liquid development is intended to prevent scattering of toner particles, which assume a particle size of about 1 $\mu$m, as well as to uniformly disperse toner particles through electrification of the toner particles. In development and electrostatic transfer processes, the carrier solvent serves as a "bridge" to facilitate movement of toner particles, which is effected by means of electric-field action.

In a liquid-development electrophotographic process, the carrier solvent is a component necessary for storage of toner, transport of toner, formation of a toner layer, and electrostatic transfer of toner. However, during and after the step of fixation of toner on paper medium, the carrier solvent is a component unnecessary for obtainment of good picture quality. Thus, at present, a volatile insulating liquid is used as a carrier solvent in many liquid developers (liquid toners). However, in consideration of fixation of toner within apparatus due to volatilization of a carrier, and effects of a volatile carrier on the human body and the environment, an electrophotographic apparatus which uses a liquid developer using a nonvolatile carrier solvent; for example, an HVS (High-Viscosity Silicone) toner, as shown in FIG. 4, is developed.

In some cases, a liquid-development toner using a nonvolatile carrier solvent may involve the following problem: the carrier solvent cannot be volatilized during melting of toner through application of heat to the liquid toner and, particularly during fixation of toner or thermal transfer of a toner image, hinders development of adhesion of a molten toner onto a paper medium, resulting in a failure to attain satisfactory picture quality and fixation strength with respect to a toner image transferred onto the paper medium.

As mentioned previously, the intermediate transfer member 15 must be heated by appropriate heating means located outside or inside the same. However, this configuration involves the following problems: since the intermediate transfer member 15 is heated at all times, the photosensitive drum 10 is heated, with a resultant deterioration in photosensitive properties; since, during removal of a carrier, a toner image is in a molten state through exposure to heat, the toner image is disturbed due to adhesion to a carrier-removing roller, resulting in an impairment in picture quality; and in a process of superposing toner images, a toner image which has previously been electrostatically transferred is in a molten state through exposure to heat and is thus disturbed during contact with the photosensitive drum, resulting in an impairment in picture quality.

2. Related Art

To solve the above problems, the present applicant filed with the Japanese Patent Office a patent application for a liquid-toner-development-type electrophotographic apparatus comprising a cooling roller for eliminating influence of heating of an intermediate transfer member on a photosensitive drum and means for removing excessive carrier at a position located upstream of a heating position where a toner layer on the intermediate transfer member is melted through application of heat (Japanese Patent Application No. 11-26960 filed on Feb. 4, 1999).

FIG. 3 shows heating and cooling mechanisms proposed in the above filed application. In FIG. 3, toner particles transferred from a photosensitive drum 10 to an intermediate transfer belt 24 are melted through application of heat. The molten toner is transferred onto a printing medium, such as paper, in a single operation. At this time, a backup roller 20 abuts a heating roller 25 under pressure so as to fix the molten toner onto the medium, such as printing paper.

The intermediate transfer belt 24 is looped around a plurality of tension rollers 26 and 27, the heating roller 25, and the cooling roller 23. A carrier-removing roller 21 is disposed in contact with the surface of the intermediate transfer belt 24 at a position located upstream of a position where the intermediate transfer belt 24 comes into contact with the heating roller 25. A bias potential is applied to the carrier-removing roller 21 while a conductive roller 19 located in opposition to the heating roller 25 is grounded, thereby removing excessive carrier as well as prewetting liquid without exerting an electrical influence on other processes, such as electrostatic transfer and thermal transfer. However, excessive carrier solvent cannot be completely removed.

Various proposals have been put forth for removing as much carrier solvent as possible from a toner image on the photosensitive drum or the intermediate transfer member. However, in the case of a nonvolatile oil, removing almost all nonvolatile oil trapped between toner particles is nearly impossible.

DISCLOSURE OF THE INVENTION

When toner particles, or a solid component of toner, are melted and integrated through application of heat, oil trapped between toner particles is isolated. Through utilization of this phenomenon, oil removal can be performed effectively.

An object of the present invention is to provide a liquid-toner-development-type electrophotographic apparatus in which the nonvolatile carrier solvent remains in a toner image on an intermediate transfer member and in which residual carrier solvent which is not removed in a carrier-removing process conducted before a heating process can be efficiently removed through utilization of a phenomenon that toner particles (resin component) are melted and integrated in the heating process and a phenomenon that a carrier solvent (liquid component) is isolated in the heating process.

In the liquid-toner-development-type electrophotographic apparatus of the present invention, a toner image is transferred from a photosensitive member onto an intermediate transfer member, and toner particles transferred onto the intermediate transfer member are melted through application of heat and transferred onto a printing medium. A carrier-removing roller, which serves as means for removing a carrier solvent, is disposed downstream of a position where a toner layer on the intermediate transfer member is melted through application of heat, and upstream of a position where the intermediate transfer member again abuts the photosensitive member.

Also, there is disposed a carrier-removing roller, which serves as means for removing the carrier solvent from the intermediate transfer member while the toner layer on the intermediate transfer member is being melted through application of heat, at a position where the toner layer is melted through application of heat.

The present invention is characterized by comprising at lease either the means for removing the carrier solvent after the toner layer is melted through application of heat, or the means for removing the carrier solvent while the toner layer is melted through application of heat. However, the present invention may comprise both of the means and may further comprise means for removing the carrier solvent (a carrier-removing roller) disposed upstream of the position where the toner layer on the intermediate transfer member is heated.

Thus, the liquid-toner-development-type electrophotographic apparatus of the present invention can separate the carrier solvent and the solid component to thereby remove the carrier solvent, by melting, through application of heat, the toner layer which is formed on the intermediate transfer member and contains a nonvolatile oil component trapped between toner particles.

BEST MODE FOR CARRYING OUT THE INVENTION

Figure 1:
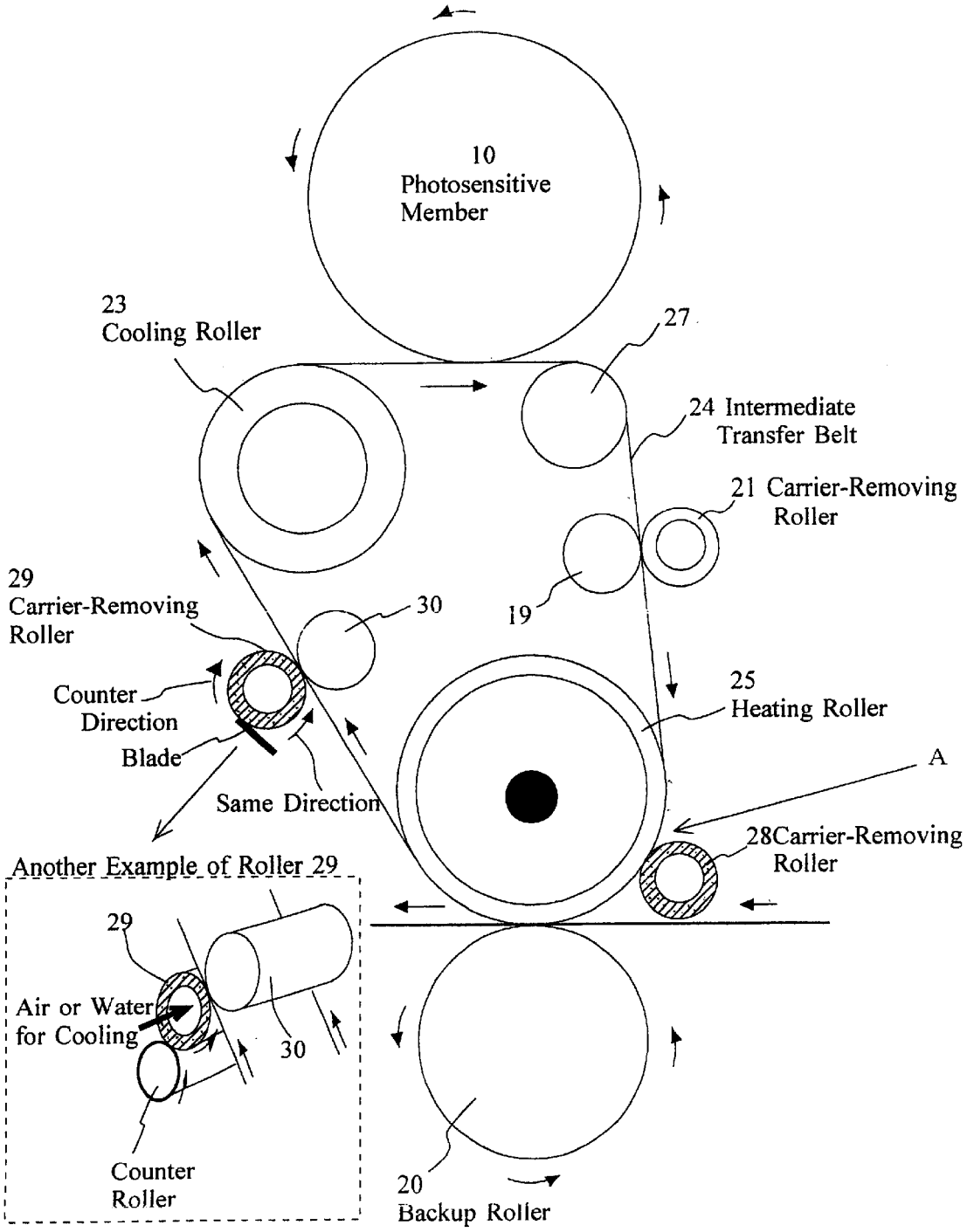
FIG. 1 is a view showing a liquid-toner-development-type electrophotographic apparatus to which the present invention s applied.

An embodiment of the present invention will next be described in detail with reference to the drawings. As in the case of the configuration which is described above with reference to FIG. 3, the electrophotographic apparatus shown in FIG. 1 is configured such that an intermediate transfer belt 24 is looped around a tension roller 27, a heating roller 25 having a heating mechanism, and a cooling roller 23. The intermediate transfer belt 24 undergoes repeatedly the following cycles of heating and cooling: the surface of the intermediate transfer belt 24 is heated to a temperature of, for example, 150° C. by means of a heating roller 25; and the intermediate transfer belt 24 is cooled to a temperature of, for example, 40° C. by means of the cooling function of the cooling roller 23. The intermediate transfer belt 24 can be driven by means of any roller. For example, the heating roller 25 may have a drive mechanism. The heating roller 25 may be an aluminum roller which can be heated by an internally disposed heat source, such as a halogen lamp.

Figure 3:
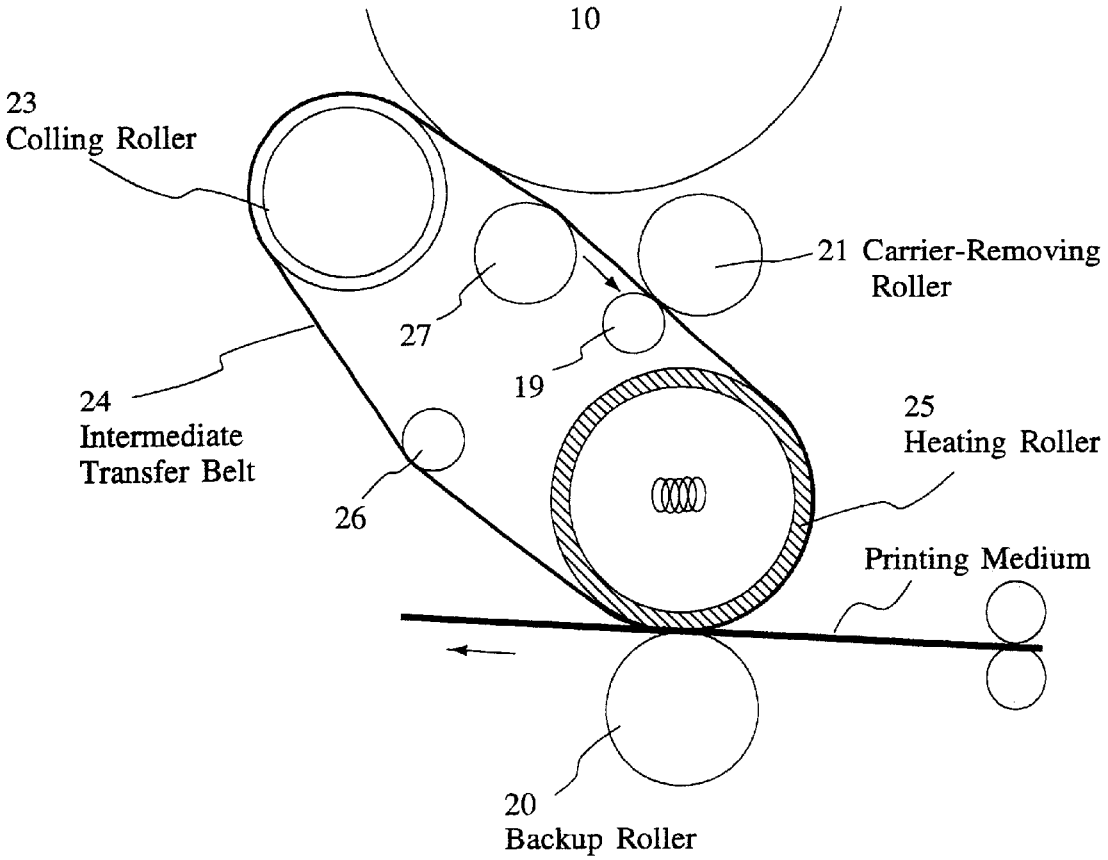
Fig.3 Prior Art
FIG. 3 is a view showing a liquid-toner-development-type electrophotographic apparatus for which the present applicant filed a patent application with Japanese Patent Office.
Figure 4:
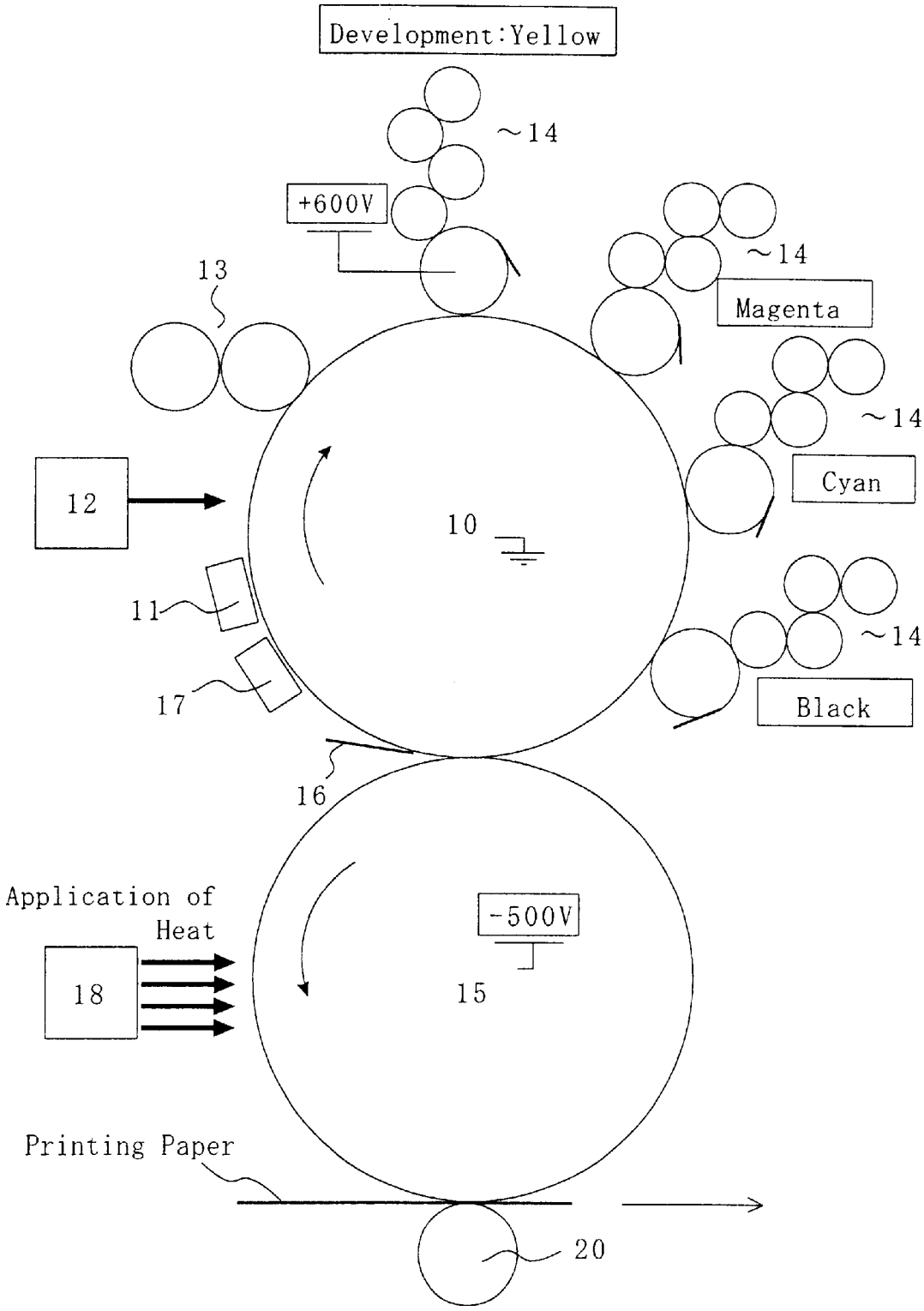
Fig. 4 Prior Art
FIG. 4 is a view showing the entire configuration of a conventional liquid-toner-development-type electrophotographic apparatus.

As in the case of the configuration of FIG. 3, the apparatus is configured such that a carrier-removing roller 21 which abuts the surface of the intermediate transfer belt 24 is disposed upstream of a position where the intermediate transfer belt 24 comes into contact with the heating roller 25. The carrier-removing roller 21 is biased at, for example, +3 KV to thereby remove not only excessive carrier but also presetting liquid. A conductive roller 19, which abuts the intermediate transfer belt 24 from inside in opposition to the carrier-removing roller 21, is grounded, whereby a bias can be applied to the carrier-removing roller 21 without exerting an electrical influence on other processes, such as electrostatic transfer and thermal transfer.

The intermediate transfer belt 24 is biased at about −500 V, whereby toner particles adhering to a photosensitive member 10 are transferred onto the intermediate transfer belt 24 according to an electric field established between the same and the photosensitive element 10. Toner particles in each of four colors are transferred from the photosensitive element 10 onto the intermediate transfer belt 24; i.e., a total of four transfers are involved. For example, first, yellow toner particles adhering to the photosensitive member 10 are transferred. Next, magenta toner particles adhering to the photosensitive member 10 are transferred. Then, cyan toner particles adhering to the photosensitive member 10 are transferred. Next, black toner particles adhering to the photosensitive member 10 are transferred. Subsequently, toner particles transferred onto the intermediate transfer belt 24 are melted through application of heat. The thus-molten toner is transferred onto a printing medium, such as paper, in a single operation. At this time, a backup roller 20 abuts the heating roller 25 under pressure so as to fix the molten toner onto the medium, such as printing paper.

The above-described configuration is substantially the same as the previously proposed configuration (FIG. 3). Next, removal of a carrier after heating and removal of a carrier during heating, which are features of the present invention, will be described with reference to the illustrated liquid-development-type electrophotographic apparatus, which employs the intermediate transfer belt 24 serving as the intermediate transfer member and includes the cooling roller 23. The present invention is not limited to the electrophotographic apparatus which employs the belt serving as the intermediate transfer member, but is applicable to an electrophotographic apparatus which employs a drum serving as the intermediate transfer member and does not employ a cooling roller.

Means for removing a carrier after heating (carrier-removing roller 29) is disposed downstream of a position where a toner layer on the intermediate transfer member is heated by means of the heating roller 25, and upstream of a position where the toner layer again abuts the photosensitive member 10. As illustrated, when the cooling roller 23 is employed, the carrier-removing roller 29 abuts the intermediate transfer belt 24 at a position located downstream of a position where the intermediate transfer belt 24 leaves the heating roller 25, and upstream of a position where the intermediate transfer belt 24 is looped around the cooling roller. At this position, the toner layer on the intermediate transfer member is in a state observed when the toner layer is once heated to a temperature equal to or higher than at least the glass transition point to thereby be melted and then cools down to a temperature equal to or lower than the glass transition point due to release of heat. Thus, the toner is in a nonadhesive state. The position is located upstream of a position where the second color toner and other color toners are each superposed on the toner through transfer.

The carrier-removing roller 29 efficiently removes the carrier solvent which, when the toner is melted and integrated on a portion of the intermediate transfer belt 24 looped around the heating roller 25, separates from a molten toner resin component and floats on the surface of the toner layer, thereby preventing a deterioration in efficiency and image during transfer of each of the second color toner and other color toners. As in the case of a combined configuration of the carrier-removing roller 21 and the conductive roller 19, which are located upstream of a heating position, a conductive roller 30, which abuts the intermediate transfer belt 24 from inside in opposition to the carrier-removing roller 29, is grounded, whereby a bias can be applied to the carrier-removing roller 29 without exerting an electrical influence on other processes, such as electrostatic transfer and thermal transfer.

As illustrated, the means for removing the carrier after heating can assume the form of the carrier-removing roller 29 and can be configured such that the surface of the carrier-removing roller 29 moves at the same speed in the same direction as does the surface of the intermediate transfer belt 24 which the surface of the carrier-removing roller 29 abuts. In order to prevent re-adhesion to the intermediate transfer belt 24 of the removed carrier solvent adhering to the carrier-removing roller 29, the carrier-removing roller 29 is provided with an unillustrated blade or counter roller (a roller which rotates such that surfaces in contact with each other move in mutually opposite directions) in contact with the same. The blade or counter roller scrapes off the carrier solvent from the carrier-removing roller 29.

When the intermediate transfer member assumes the form of the intermediate transfer belt 24 as illustrated, the carrier-removing roller 23 is brought in press contact with a so-called "belly portion" of the intermediate transfer belt 24 (an intermediate portion which extends between rollers and is not looped around rollers, such as the heating roller 25 and the cooling roller 23), thereby establishing soft stable contact. In this case, the carrier-removing roller 29 also plays the role of a tension roller.

A roller which rotates in the same direction at the same speed as does the intermediate transfer belt 24 can remove only half of the carrier solvent emerging on the surface of the intermediate transfer belt 24. Toner which is once melted through application of heat is fixedly attached to the surface of the intermediate transfer belt 24 (even when the surface is coated with a release coat), although the attachment is not firm. Thus, the carrier-removing roller 29 for removing the carrier after heating is rotated in reverse (rotated in the counter direction such that surfaces in contact with each other move in mutually opposite directions) with respect to rotation of the intermediate transfer belt 24 while maintaining soft contact with the intermediate transfer belt 24, thereby scraping off only carrier liquid. The carrier-removing roller 29 can be formed such that the surface of a foamed material is coated with a fluorine-containing resin tube, thereby establishing uniform, soft press contact with the belt surface.

Figure 2:
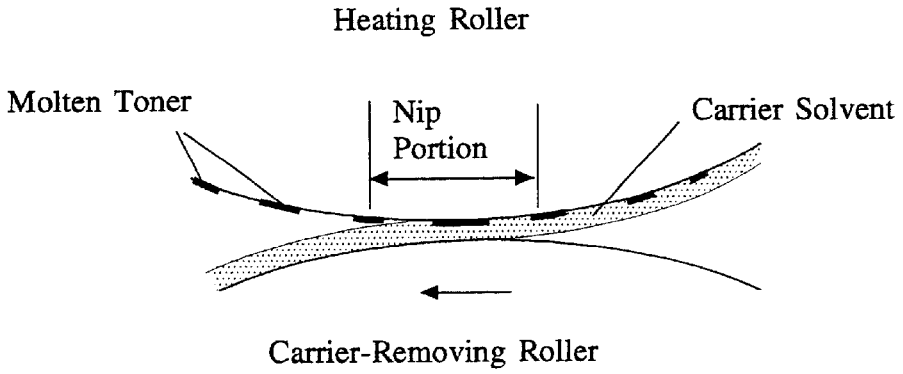
FIG. 2 is an enlarged view of portion A of the apparatus of FIG. 1.

Also, the electrophotographic apparatus of the present invention can employ means for removing the carrier solvent (carrier-removing roller 28) while the toner layer on the intermediate transfer member is being melted through application of heat by means of the heating roller 25. As seen in FIG. 2, which is an enlarged view of portion A of the apparatus of FIG. 1, the carrier-removing roller 28 efficiently removes the carrier solvent which, when the toner is melted and integrated on a portion of the intermediate transfer belt 24 looped around the heating roller 25, separates from a molten toner resin component and floats on the surface of the toner layer, thereby preventing a deterioration in efficiency and image during transfer of each of the second color toner and other color toners. Since the carrier is removed while the toner is being melted through application of heat, the carrier can be removed effectively and quickly even when the final (fourth color) toner layer is processed, or even in a monochromatic process. The carrier-removing roller 28 removes the carrier solvent while the toner layer on the intermediate transfer member is heated to a temperature equal to or higher than at least the glass transition point to thereby be melted.

In order to effectively remove the carrier solvent, the carrier-removing rollers 28 and 29 can each assume the form of a liquid absorptive roller having fine continuous foam cells formed therein to thereby enhance a function for absorbing the carrier solvent. The liquid absorptive roller can be formed of, for example, special urethane sponge "WETRON" produced by Kanebo, Ltd. In this case, preferably, a high-hardness roller or the like is pressed against the surface of each of the carrier-removing rollers 28 and 29 to thereby squeeze out carrier liquid, whereby the carrier liquid absorbed in the liquid absorptive carrier-removing roller can be collected.

The carrier-removing roller 28, which is adapted to remove a carrier during heating and which has a surface coated with a fluorine-containing resin coating or fluorine-containing resin tube having excellent releasability, can be brought in rotational contact with the belt surface such that the surface thereof moves at the same speed in the same direction as does the belt surface, thereby preventing "offset phenomenon," in which adhesiveness of the molten toner causes the molten toner to be transferred onto the surface of the carrier-removing roller 28 at a portion of the carrier-removing roller 28 which is looped around the heating roller 25. In order to prevent re-adhesion to the belt surface of the removed carrier solvent adhering to the carrier-removing roller 28, the carrier-removing roller 28 has an unillustrated blade or counter roller in contact with the same and adapted to scrape off the carrier solvent from the same.

When the carrier-removing roller 29 for removing a carrier after heating, or particularly the carrier-removing roller 28 for removing a carrier during heating, is kept in contact with the heated belt, the temperature of the carrier-removing roller 29 or 28 increases gradually. As a result, adhesiveness of the molten toner causes the molten toner to be transferred onto the roller surface (offset phenomenon). In order to prevent the offset phenomenon, the carrier-removing roller can be cooled so as to be maintained at room temperature.

In order to cool the carrier-removing roller, the carrier-removing roller can assume the form of a pipe roller through which air or cooling water flows to thereby accelerate release of heat. Thus, the entirety of the carrier-removing roller can be cooled effectively. A pipe material is preferably aluminum or copper, which exhibit excellent thermal conductivity.

The carrier-removing roller can assume the form of a semiconductive roller having a resistance of $10^6$ Ω to $10^{10}$ Ω. A bias voltage of, for example, 1 KV to 3 KV is applied to the carrier-removing roller such that an electric field established at a nip portion causes the molten toner to moved toward the belt. Thus, the charged molten toner in the carrier solvent is shifted toward the belt by means of electric-field action, thereby achieving resistance to offset onto the roller and effective removal of the carrier.

Industrial Applicability

As described above, according to the present invention, a carrier-removing roller 29, which serves as means for removing a carrier solvent, is disposed downstream of a position where a toner layer on an intermediate transfer member is melted through application of heat, and upstream of a position where the intermediate transfer member again abuts a photosensitive member, or there is disposed a carrier-removing roller 28, which serves as means for removing the carrier solvent from the intermediate transfer member while the toner layer on the intermediate transfer member is being melted through application of heat, at a position where the toner layer is melted through application of heat. Thus, residual carrier solvent which is not removed in a carrier-removing process conducted before a heating process can be removed efficiently through utilization of a phenomenon that toner particles (resin component) are melted and integrated in the heating process and a phenomenon that the carrier solvent (liquid component) is isolated in the heating process.

What is claimed is:

1. A liquid-toner-development-type electrophotographic apparatus in which a toner image is transferred from a photosensitive member onto an intermediate transfer member and in which toner particles transferred onto the intermediate transfer member are melted through application of heat and transferred onto a printing medium, comprising:

means for removing a nonvolatile carrier solvent remaining in a toner image on the intermediate transfer member at a position located downstream of a position where a toner layer on the intermediate transfer member is melted through application of heat, and upstream of a position where the molten toner layer abuts the photosensitive member.

2. A liquid-toner-development-type electrophotographic apparatus as recited in claim 1, wherein the means for removing the carrier solvent comprises a roller having a surface making contact with a surface of the intermediate transfer member and moving at a same speed in a same direction as the surface of the intermediate transfer member, and a blade or a counter roller making contact with the roller and adapted to scrape off the carrier solvent.

3. A liquid-toner-development-type electrophotographic apparatus as recited in claim 1, wherein the means for removing the carrier solvent comprises a liquid absorptive roller having fine continuous foam cells formed therein.

4. A liquid-toner-development-type electrophotographic apparatus as recited in claim 1, wherein the means for removing the carrier solvent comprises a roller having a surface which comes into contact with a surface of the intermediate transfer member and moves in a direction counter to a direction in which the surface of the intermediate transfer member moves, while maintaining a soft contact with the surface of the intermediate transfer member.

5. A liquid-toner-development-type electrophotographic apparatus as recited in claim 4, wherein the roller comprises a surface of a foamed material coated with a fluorine-containing resin tube.

6. A liquid-toner-development-type electrophotographic apparatus as recited in claim 4, wherein the intermediate transfer member comprises a belt, and the roller is in contact with a belly portion of the belt.

7. A liquid-toner-development-type electrophotographic apparatus as recited in claim 1, wherein the means for removing the carrier solvent comprises one of a roller having a surface coated with a fluorine-containing resin coating and a fluorine-containing resin tube having excellent releasability.

8. A liquid-toner-development-type electrophotographic apparatus as recited in claim 1, wherein the means for removing the carrier solvent comprises a roller and the apparatus further comprises cooling means for cooling the roller.

9. A liquid-toner-development-type electrophotographic apparatus as recited in claim 8, wherein the roller assumes a form of a pipe roller, and the cooling means comprises means for causing air or cooling water to flow through the pipe roller.

10. A liquid-toner-development-type electrophotographic apparatus as recited in claim 1, wherein the means for removing the carrier solvent comprises a semiconductive roller having a resistance of $10^6$ Ω to $10^{10}$ Ω, where a bias voltage is applied to the semiconductive roller in a direction so as to move molten toner toward the intermediate transfer member.

11. A liquid-toner-development-type electrophotographic apparatus in which a toner image is transferred from a photosensitive member onto an intermediate transfer member and in which toner particles transferred onto the intermediate transfer member are melted through application of heat and transferred onto a printing medium, comprising:

means for removing a nonvolatile carrier solvent remaining in the toner image on the intermediate transfer member while a toner layer on the intermediate transfer member is being melted through application of heat, wherein the means for removing the nonvolatile carrier solvent comprises a roller; and cooling means for cooling the roller.

12. A liquid-toner-development-type electrophotographic apparatus as described in claim 11, wherein the roller assumes a form of a pipe roller, and the cooling means assumes a form of means for causing air or cooling water to flow through the pipe roller.

13. A liquid-toner-development-type electrophotographic apparatus in which a toner image is transferred from a photosensitive member onto an intermediate transfer member and in which toner particles transferred onto the intermediate transfer member are melted through application of heat and transferred onto a printing medium, comprising:

a carrier-removing roller removing a nonvolatile carrier solvent remaining in a toner image on the intermediate transfer member at a position located downstream of a position where a toner layer on the intermediate transfer member is melted through application of heat, and upstream of a position where the molten toner layer abuts the photosensitive member.

14. A liquid-toner-development-type electrophotographic apparatus in which a toner image is transferred from a photosensitive member onto an intermediate transfer member and in which toner particles transferred onto the intermediate transfer member are melted through application of heat and transferred onto a printing medium, comprising:

a unit removing a nonvolatile carrier solvent remaining in the toner image on the intermediate transfer member while a toner layer on the intermediate transfer member is being melted through application of heat, wherein the unit removing the nonvolatile carrier solvent comprises a roller; and cooling unit cooling the roller.

* * * * *